United States Patent [19]

Bjor

[11] Patent Number: 4,537,263

[45] Date of Patent: Aug. 27, 1985

[54] METHOD AND MEANS FOR ADJUSTING THE FEED SUPPORT OF A ROCK DRILLING UNIT INTO A GIVEN DISTANCE FROM THE DRILLING LOCATION

[75] Inventor: Hakon E. Bjor, Hvalstad, Norway

[73] Assignee: Ingeniør Thor Furuholmen A/S, Oslo, Norway

[21] Appl. No.: 372,237

[22] Filed: Apr. 26, 1982

[30] Foreign Application Priority Data

Apr. 29, 1981 [NO] Norway ..... 811458

[51] Int. Cl.[3] ..... E21B 15/04

[52] U.S. Cl. ..... 173/1; 173/11; 173/43

[58] Field of Search ..... 173/1, 6, 11, 12, 21, 173/22, 39, 43, 166–167; 299/1, 10; 408/17; 175/27, 38, 40, 51

[56] References Cited

U.S. PATENT DOCUMENTS

| | | | |
|---|---|---|---|
| 3,744,575 | 7/1973 | Strömmes | 173/31 |
| 3,980,144 | 9/1976 | Roos et al. | 173/43 X |
| 4,113,033 | 9/1978 | Lindblad | 173/21 X |
| 4,230,189 | 10/1980 | Mashimo | 173/43 X |
| 4,339,946 | 7/1982 | Cole | 173/21 X |
| 4,354,779 | 10/1982 | Vaughn | 173/21 X |

*Primary Examiner*—James M. Meister
*Assistant Examiner*—John L. Knoble
*Attorney, Agent, or Firm*—Wenderoth, Lind & Ponack

[57] ABSTRACT

The feed support of a rock drilling unit is adjusted to be a given distance from a rock surface wherein holes are to be drilled. A drill bit is moved into abutment with the rock surface. The feed support is moved relative to the bit toward the rock surface. Such movement is stopped when a depth measuring instrument determines that the feed support is at a position spaced the given distance from the rock surface.

13 Claims, 2 Drawing Figures

METHOD AND MEANS FOR ADJUSTING THE FEED SUPPORT OF A ROCK DRILLING UNIT INTO A GIVEN DISTANCE FROM THE DRILLING LOCATION

BACKGROUND OF THE INVENTION

The present invention relates to a method for adjusting the drill feed support of a rock drilling unit to a position a given distance from a rock surface in which holes are to be drilled to a depth which is read by means of a measuring instrument. Further, the invention relates to a means for performing such method.

When drilling holes in rocks the feed support with a drill stem and drill stem guides is moved sideways from hole to hole. This sideways movement should take place at such a distance from the rock surface that the drill and feed support with stem guides do not collide with the rock and become damaged. When the drill has reached a correct position for drilling another hole, it is important that the feed support with its front end stem guide is moved as close to the rock surface as possible, without contacting the rock surface.

This distance by which the feed support has to be moved forward for setting of the drill in a start drilling position, will be different from one hole to another dependent on the exterior of the rock surface. When using automatically operated drilling units there is a need for this forward movement to be controlled automatically, particularly when the drilling unit has more than one drill boom with feed support.

Such automatic forward movement of the feed support has not been known previously, but may be obtained in theory by means of a sensor which either measures the distance from the feed support to the rock surface, or detects if this distance is less than a predetermined or defined length. An example of a practicable distance measuring instrument that includes a sensor, is a buffer which may be mounted on the front end of the feed support, and which may be resilient to give a signal when contacting the rock. Another example is a distance measuring sensor mounted in the front end stem guide. A further example is an arrangement including mechanical feelers which give a signal when reaching the rock.

A common feature of these solutions is that they require additional elements on the feed support. Such elements make the drill equipment more complicated. These elements in addition will make the equipment more expensive, as they are situated on an extremely exposed location where they easily get damaged when colliding with the rock or when being hit by falling stones, or they become disabled by being covered with drilling mud, and thus have to be replaced often.

SUMMARY OF THE INVENTION

The object of the present invention is to provide a method for adjusting the feed support to a given distance from the rock surface, without the need for additional elements that have to be mounted at positions where they easily get damaged during use. A further object is to provide a means for performing such a method, which means is capable of performing such adjustment automatically.

The method according to the invention is characterized in that the drill stem and bit are used together with a drilling depth measuring instrument to adjust the feed support to the given distance from the rock surface. The stem and bit are moved forward until the bit stops against the rock surface, and then the drill stem and feed support are moved relative to each other until the measuring instrument reads that the support is spaced from the rock surface by the given distance, while the drill bit is in contact with the rock surface.

This method results in that additional elements do not need to be mounted on the feed support or on the remaining movable and exposed parts of the drill boom, because the drill stem and bit proper act as a distance measuring instrument.

According to the invention a means for performing the method defined above is characterized in that the drilling depth measuring instrument is connected to a control unit for controlling relative movement between the feed support and a carrier for the feed support, on the basis of the given distance as calculated between the feed support and the drill bit. Thus, the method can be performed automatically in a simple manner. In principle, any previously known drilling depth measuring instrument can be used. In the present invention, however, a volumetric quantity measuring instrument is preferred, which instrument measures the quantity of oil that flows in a volumetric feeding motor for the drilling machine, this motor usually being a hydraulic cylinder. This quantity measuring instrument, which often may be mounted for other purposes, can for instance be mounted together with control valves of the hydraulic power unit which is placed at the rear end of the drilling unit, and thus is well protected.

BRIEF DESCRIPTION OF THE DRAWINGS

The invention now will be described further by means of examples of performance of the method and the means therefor, with reference to the enclosed drawings, wherein.

DETAILED DESCRIPTION OF THE INVENTION

Figure 1:
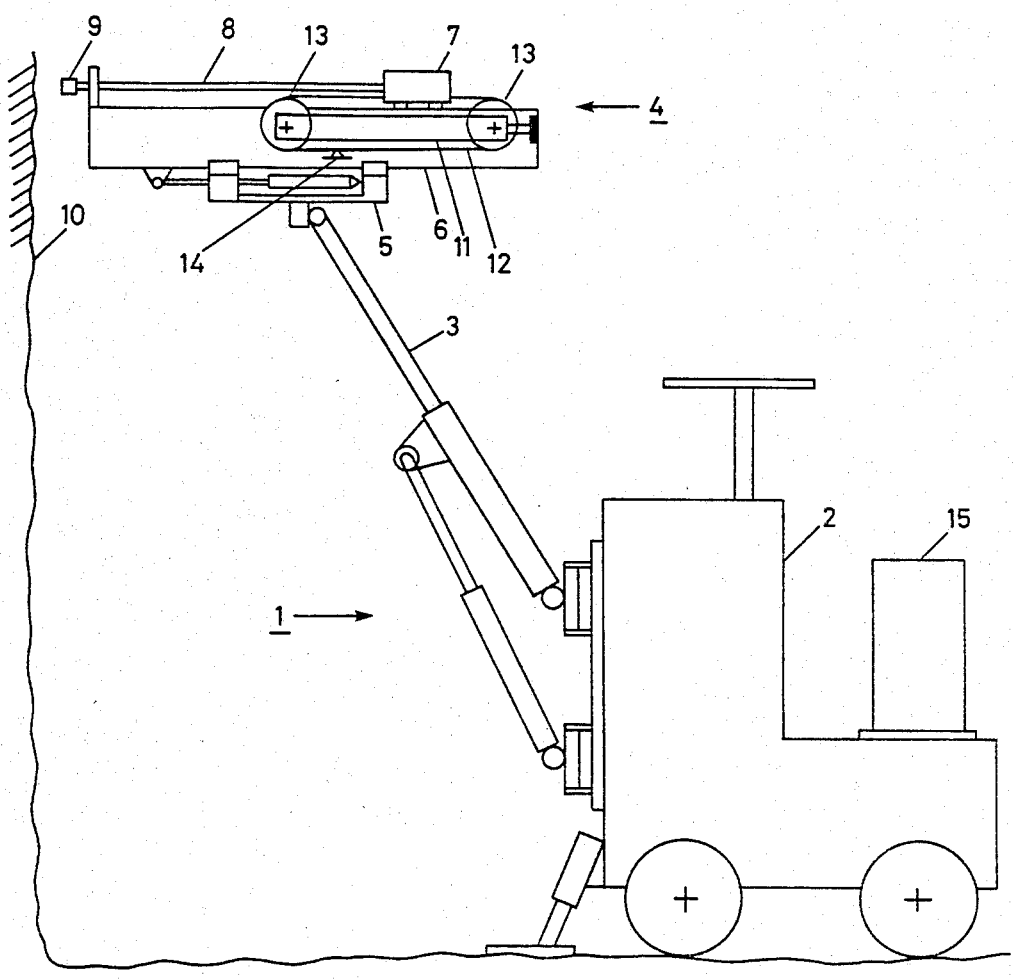
FIG. 1. is a schematic view of a rock drilling unit of a generally known type but modified according to the invention.

In FIG. 1 the number 1 denotes a rock drilling unit including an undercarriage or support 2 having mounted thereon at least one articulated drill boom 3 having connected thereto drilling equipment 4. The equipment 4 comprises a carrier 5 for a feed support 6, on which a drilling machine 7 with a drill stem 8 and drill bit 9 can slidably be moved backwards and forwards in relation to a rock surface 10 in which holes are to be drilled. The drilling machine 7 is moved by means of a hydraulically driven feed motor 11 via a feed chain 12 which runs over two sprocket wheels 13, which is fixed to the drilling machine 7, and which is fixed to the feed support 6 at a fixing position 14. Hydraulic supply conduits extend from a hydraulic power supply unit 15, which conduits are described below.

Figure 2:
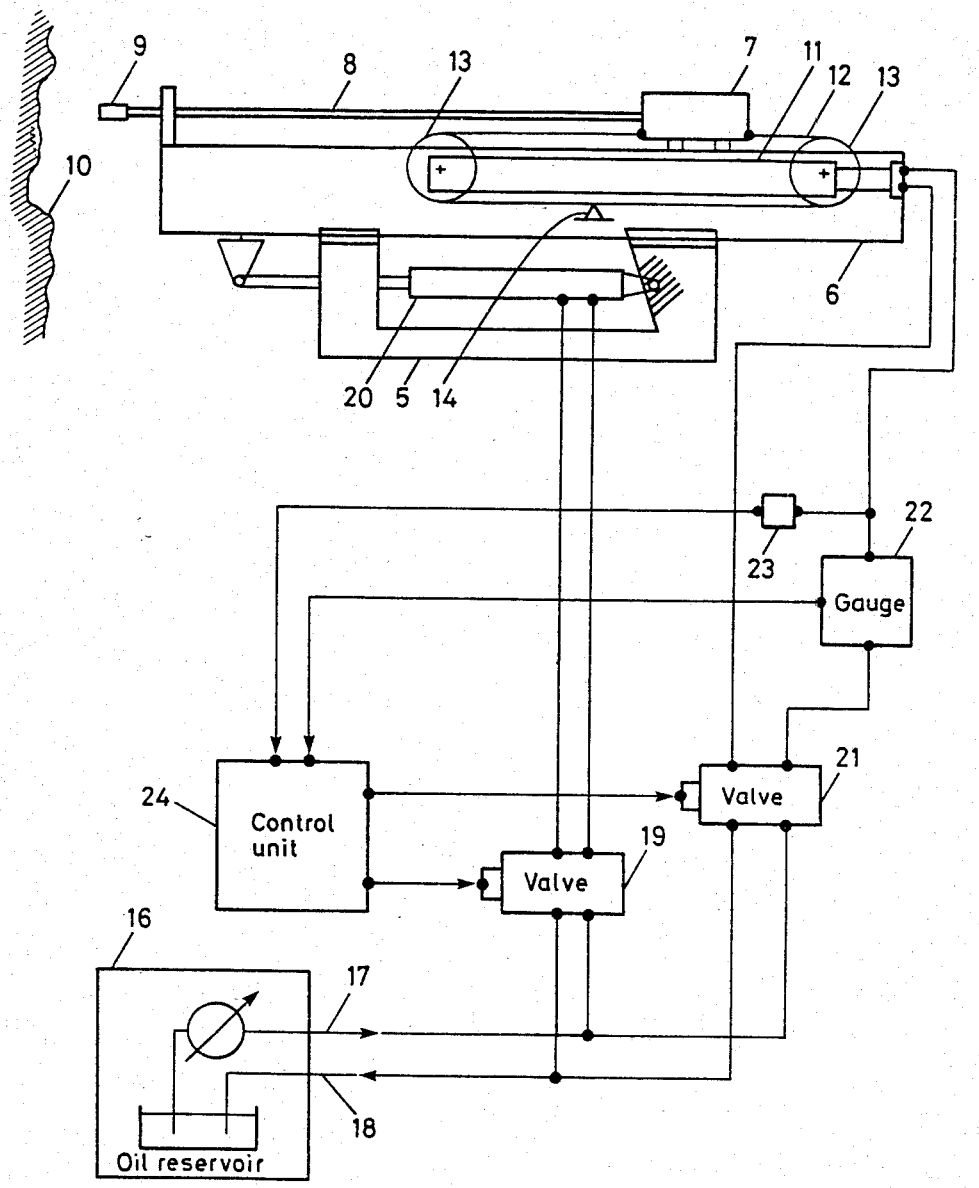
FIG. 2 is a schematic view of a portion of the drilling equipment in FIG. 1, shown on an enlarged scale, with power supply conduits and related equipment, and including the feature according to the invention.

In figure 2 is shown the carrier 5 mentioned above, as well as the feed support 6, drilling machine 7 and drill stem 8 with the bit 9 facing the rock surface 10. Further is shown the feed motor 11, as well as the feed chain 12, wheels 13 and the fixing position 14. Additionally is shown an oil reservoir 16 with a hydraulic supply conduit 17 and return conduit 18. Further is shown a control valve 19 for a feed-extension motor 20. Still further is shown a control valve 21 for the feed motor 11. According to the invention, there is provided a drilling depth measuring instrument coupled between the valve 21 and the motor 11, such instrument being in the form of a volumetric quantity measuring instrument 22. A pressure gauge 23 may be coupled downstream the instrument 22. An automatic control unit 24, for instance a microprocessor, controls relative movement between the feed support 6 and the carrier 5. When the drill stem 8 and bit 9 are displaced from one hole to another, the drilling machine 7 with drill stem 8 and bit 9 is located at a rear end position on the feed support 6. The feed support 6, which can be moved in relation to the carrier 5, is as well moved backwards from the rock surface by an amount such that collision with the rock is avoided for certain. When the feed support 6 has been adjusted to a correct position and direction for drilling the next hole, the feed support 6 is moved forward towards the uneven rock surface 10 for setting of the drill bit 9.

Setting of the drill bit 9 may be performed by moving the stem 8 and bit 9 forward under a limited feeding power controlled by the valve 21, until the drill bit 9 contacts the rock 10 and stops. The fact that the drill bit 9 has contacted the rock can be read by means of the quantity measuring instrument 22, or by means of the pressure gauge 23. While the limited feeding power is maintained on the drill stem 8, the feed-extension motor 20 pushes the feed support 6 forward, with respect to carrier 5, towards the rock surface 10. This movement is controlled by the control unit 24 and valve 19. Thus, the position of the drill stem 8 and bit 9 on feed support 6 is retracted as the feed support 6 moves forwardly with respect thereto. This relative movement continues until the quantity measuring instrument 22 shows that the feed support 6 is a preadjusted given distance from the rock surface 10. Then the movement of the feed support 6 is stopped, and drilling of a new hole may be started.

Instead of using a volumetric quantity measuring instrument 22 as a drilling depth measuring instrument, the latter may be in the form of any suitable depth measuring instrument mounted for instance on the feed support 6, or it may be an end position feeler (not shown) mounted for instance on the rear end of the feed support 6.

The procedure described above can be performed in a number of alternative ways, either sequentially as has been described above, or by starting the forward movement of both the drill stem 8 and feed support 6 simultaneously in order to save time, whereby the stem 8 is pressed backwards in relation to the feed support 6 because of the limited feeding power from the feed motor 11. The stem 8 is pressed back with respect to feed support 6 until the depth measuring instrument 22 shows that the feed support 6 is sufficiently close to the rock surface 10. Then the described movements are stopped, and the drilling operation can start.

In another alternative procedure wherein the drill stem 8 and feed support 6 are moved forward simultaneously, the stem 8 may be withdrawn as soon as the drilling depth measuring instrument 22 or the pressure gauge 23 detects that the drill bit 9 is in contact with the rock surface 10, provided that the feed support 6 is equipped with a particular feeler (not shown) which measures the movement of the support 6 in relation to the carrier 5. Before the stem 8 and bit 9 are withdrawn. The depth measuring instrument 22 is read, whereafter the feed support 6 is still moved forward, in this case a distance which has been derived from the reading of the depth measuring instrument.

During the forward movement of the feed support 6 the stem 8 and bit 9 may be withdrawn a slight amount such that the stem 8 will not be caused to bend in relation to the rock.

The method and means of the invention may as well be used in connection with tunnel drilling units, with units for drilling in open pits, or with any drilling unit where a drilling machine is moved along a feed support.

I claim:

1. A method for positioning at a predetermined distance from a rock surface into which holes are to be drilled a feed support of a rock drilling unit of the type including a carrier supporting said feed support for longitudinal movement relative thereto, first hydraulic means for moving said feed support longitudinally with respect to said carrier, a drilling machine mounted on said feed support for longitudinal movement relative thereto, a drill stem supported by said drilling machine and movable therewith, a drill bit fixed to an end of said drill stem, second hydraulic means for moving said drilling machine, said stem and said bit longitudinally with respect to said feed support, and means for measuring the depth of a drilled hole as a function of the relative position of said drilling machine with respect to said feed support, said method comprising:

operating said second hydraulic means and thereby moving said drilling machine, said stem and said bit toward said rock surface until said bit abuts said rock surface;

operating said first hydraulic means to move said feed support toward said rock surface, while maintaining said bit in abutment with said rock surface, whereby said feed support moves relative to said drilling machine; and stopping operation of said first hydraulic means and thereby movement of said feed support when said depth measuring means determines that said feed support has reached a position spaced said predetermined distance from said rock surface, as a function of the relative position of said bit, and thereby of said drilling machine, with respect to said feed support.

2. A method as claimed in claim 1, comprising operating said second hydraulic means at a power less than normally employed for drilling.

3. A method as claimed in claim 2, comprising initiating operation of said first hydraulic means after said bit has contacted said rock surface.

4. A method as claimed in claim 2, comprising simultaneously operating said first and second hydraulic means.

5. A method for positioning at a predetermined distance from a rock surface into which holes are to be drilled a feed support of a rock drilling unit of the type including a carrier supporting said feed support for longitudinal movement relative thereto, first hydraulic means for moving said feed support longitudinally with respect to said carrier, a drilling machine mounted on said feed support for longitudinal movement relative thereto, a drill stem supported by said drilling machine and movable therewith, a drill bit fixed to an end of said drill stem, second hydraulic means for moving said drilling machine, said stem and said bit longitudinally with respect to said feed support, and means for measuring the depth of a drilled hole as a function of the relative position of said drilling machine with respect to said feed support, said method comprising:

operating said first hydraulic means to move said feed support toward said rock surface, and simultaneously operating said second hydraulic means and thereby moving said drilling machine, said stem and said bit toward said rock surface until said bit abuts said rock surface;

when said bit abuts said rock surface, determining from said depth measuring means the relative position of said rock surface as a function of the position of said bit and thereby said drilling machine with respect to said feed support;

thereafter, operating said second hydraulic means to withdraw said drilling machine, said stem and said bit from said rock surface, thereby to prevent bending of said stem, while continuing operation of said first hydraulic means and movement of said feed support toward said rock surface; and stopping operation of said first hydraulic means and thereby movement of said feed support upon measurement by said depth measuring means that said feed support has reached a position spaced said predetermined distance from said relative position of said rock surface.

6. In a rock drilling unit for drilling holes in a rock surface, said unit being of the type including a carrier, a feed support mounted on said carrier for longitudinal movement relative thereto, first hydraulic means for moving said feed support longitudinally with respect to said carrier, a drilling machine mounted on said feed support for longitudinal movement relative thereto, a drill stem supported by said drilling machine and movable therewith, a drill bit fixed to an end of said drill stem, second hydraulic means for moving said drilling machine, said stem and said bit longitudinally with respect to said feed support, and means for measuring the depth of a drilled hole as a function of the relative position of said drilling machine with respect to said feed support, the improvement of means for, at the beginning of a drilling operation, positioning said feed support a predetermined distance from the rock surface, said positioning means comprising control means, operatively connected to said first hydraulic means, said second hydraulic means and said depth measuring means, for:

operating said second hydraulic means and thereby moving said drilling machine, said stem and said bit toward the rock surface until said bit abuts the rock surface;

operating said first hydraulic means to move said feed support toward the rock surface, while maintaining said bit in abutment with the rock surface, whereby said feed support moves relative to said drilling machine; and stopping operation of said first hydraulic means and thereby movement of said feed support when said depth measuring means determines that said feed support has reached a position spaced said predetermined distance from the rock surface, as a function of the relative position of said bit, and thereby of said drilling machine, with respect to said feed support.

7. The improvement claimed in claim 6, wherein said depth measuring means comprises a feeler gauge mounted on said feed support.

8. The improvement claimed in claim 6, further comprising a hydraulic circuit connecting said first and second hydraulic means to a source of hydraulic fluid, and wherein said depth measuring means comprises volumetric quantity measuring means, provided in said circuit between said source and said second hydraulic means, for measuring relative quantities of said fluid supplied to said second hydraulic means.

9. The improvement claimed in claim 8, further comprising pressure gauge means, provided in said circuit, for detecting when said bit abuts the rock surface.

10. In a rock drilling unit for drilling holes in a rock surface, said unit being of the type including a carrier, a feed support mounted on said carrier for longitudinal movement relative thereto, first hydraulic means for moving said feed support longitudinally with respect to said carrier, a drilling machine mounted on said feed support for longitudinal movement relative thereto, a drill stem supported by said drilling machine and movable therewith, a drill bit fixed to an end of said drill stem, second hydraulic means for moving said drilling machine, said stem and said bit longitudinally with respect to said feed support, and means for measuring the depth of a drilled hole as a function of the relative position of said drilling machine with respect to said feed support, the improvement of means for, at the beginning of a drilling operation, positioning said feed support a predetermined distance from the rock surface, said positioning means comprising control means, operatively connected to said first hydraulic means, said second hydraulic means and said depth measuring means, for:

operating said first hydraulic means to move said feed support toward the rock surface, and simultaneously operating said second hydraulic means and thereby moving said drilling machine, said stem and said bit toward the rock surface until said bit abuts the rock surface;

when said bit abuts the rock surface, determining from said depth measuring means the relative position of the rock surface as a function of the position of said bit and thereby said drilling machine with respect to said feed support;

thereafter operating said second hydraulic means to withdraw said drilling machine, said stem and said bit from the rock surface, thereby to prevent bending of said stem, while continuing operation of said first hydraulic means and movement of said feed support toward the rock surface; and stopping operation of said first hydraulic means and thereby movement of said feed support upon measurement by said depth measuring means that said feed support has reached a position spaced said predetermined distance from said relative position of the rock surface.

11. The improvement claimed in claim 10, wherein said depth measuring means comprises a feeler gauge mounted on said feed support.

12. The improvement claimed in claim 10, further comprising a hydraulic circuit connecting said first and second hydraulic means to a source of hydraulic fluid, and wherein said depth measuring means comprises volumetric quantity measuring means, provided in said circuit between said source and said second hydraulic means, for measuring relative quantities of said fluid supplied to said second hydraulic means.

13. The improvement claimed in claim 12, further comprising pressure gauge means, provided in said circuit, for detecting when said bit abuts the rock surface.

* * * * *